United States Patent [19]

McNeill

[11] Patent Number: 5,042,715

[45] Date of Patent: Aug. 27, 1991

[54] FOLDING CARTON

[76] Inventor: Allen McNeill, 871 Twin Pine Dr., St. Louis, Mo. 63122

[21] Appl. No.: 577,683

[22] Filed: Sep. 4, 1990

[51] Int. Cl.[5] ..... B65D 5/26; B65D 5/46

[52] U.S. Cl. ..... 229/117.15; 229/194

[58] Field of Search ..... 229/117.14, 117.15, 229/194, 193

[56] References Cited

U.S. PATENT DOCUMENTS

| | | | |
|---|---|---|---|
| 1,011,752 | 12/1911 | Cowlishaw | 229/117.14 |
| 1,527,399 | 2/1925 | Davidson | 229/194 |
| 1,982,962 | 12/1934 | McAleer | 229/194 |
| 1,983,010 | 12/1934 | Spees | 229/194 |
| 2,714,982 | 8/1955 | Strauss | 229/117.15 |
| 2,805,813 | 9/1957 | Rittmueller | 229/117.15 |
| 3,722,782 | 3/1973 | Collie | 229/117.15 |

FOREIGN PATENT DOCUMENTS

| | | | |
|---|---|---|---|
| 2932610 | 2/1981 | Fed. Rep. of Germany | 229/117.15 |
| 940449 | 12/1948 | France | 229/117.15 |
| 1281319 | 12/1961 | France | 229/117.14 |
| 289495 | 3/1965 | Netherlands | 229/117.15 |
| 7805903 | 12/1979 | Netherlands | 229/117.14 |
| 253373 | 11/1948 | Switzerland | 229/117.15 |

*Primary Examiner*—Gary E. Elkins

*Attorney, Agent, or Firm*—Rogers, Howell & Haferkamp

[57] ABSTRACT

A single blank of sheet material is configured to be formed into a folding carton having a bottom panel, mutually opposed side panels, and mutually opposed end panels, with front and back top panels that are arranged to be closed over a top opening of the folding carton to close the top opening of the carton and form a carrying handle for the carton. The folding carton is assembled solely from the single blank of sheet material without the use of glue or adhesives or any other manner of securing one carton component to another that is separate from the single blank of sheet material.

11 Claims, 3 Drawing Sheets

FIG. 7.
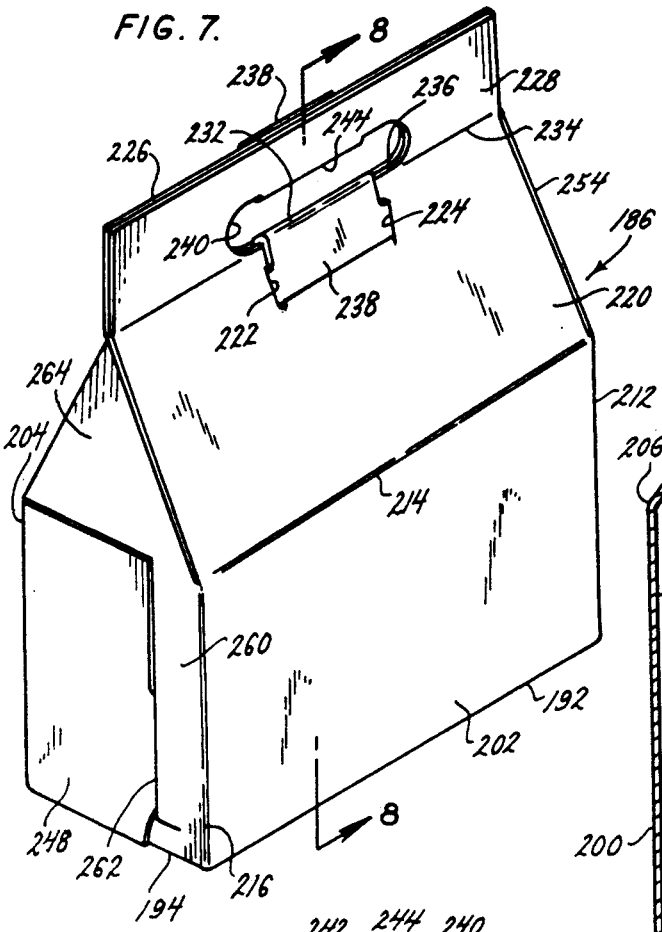
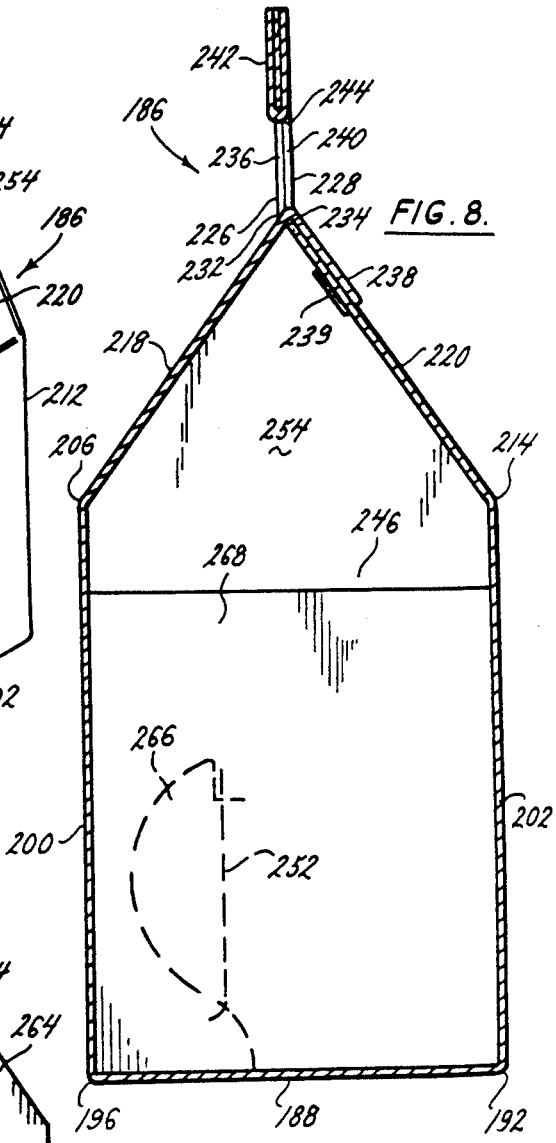
FIG. 8.
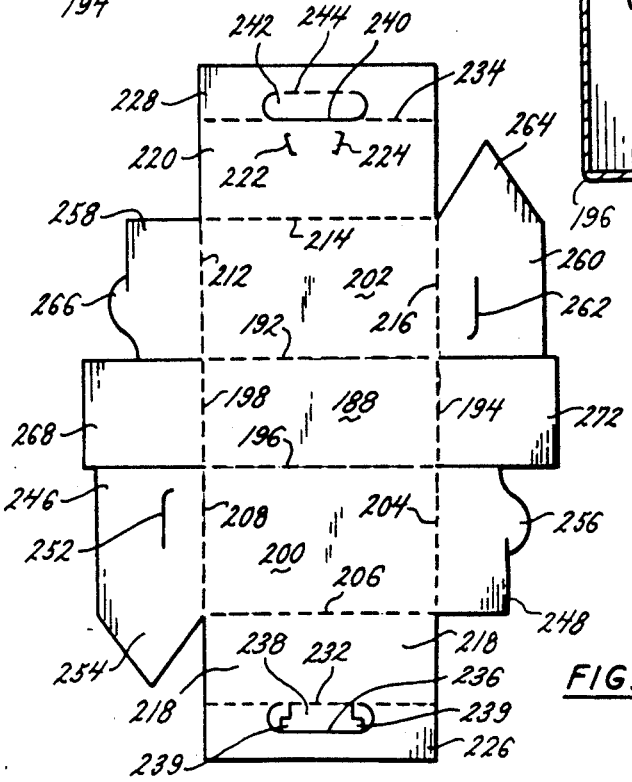
FIG. 9.

FOLDING CARTON

BACKGROUND OF THE INVENTION (1) Field of the Invention

The present invention pertains to a folding carton that is cut from a single blank of sheet material and is folded and assembled, without the use of glue, into a generally rectangular shaped carton having a top closure incorporating a carrying handle.

(2) Description of the Related Art

Many different shapes and sizes of folding cartons are known in the prior art. In many prior art folding cartons, their assembly from a blank sheet of material to a form from which they can be easily folded to or assembled to a box configuration often involves a gluing step. In the gluing step, one or more seams or sides of the prior art carton are glued together in order to enable the blank sheet of material to be folded from a flat storage configuration to its box configuration. In many prior art methods of manufacturing folding cartons, the gluing step is necessary in order for the carton to be folded or assembled to and maintain its box configuration.

A disadvantage associated with the gluing step involved in manufacturing prior art folding cartons is that it necessitates at least one extra step in the manufacturing process of forming a blank of sheet material into a folding carton. This additional step often accounts for a significant percentage of the total time required in manufacturing a blank of sheet material into a folding carton.

The gluing step also often adds significantly to the cost involved in manufacturing folding cartons. This is especially so when only a limited number of cartons are being produced and the cost involved in applying glue to the blank of sheet material and incorporating a gluing step in the overall assembly of the carton cannot be spread over a large number of cartons.

What is needed to reduce the time and cost involved in the manufacture of folding cartons is a folding carton that can be assembled from a single blank of sheet material into a three-dimensional box configuration that does not require glue or glue-like substances, or a gluing step in its manufacture.

It is an object of the present invention to provide a folding carton that is assembled into a three-dimensional box configuration from a single blank of sheet material, where the carton does not require glue or a glue-like substance to maintain or hold the folding carton in its assembled box configuration.

It is also an object of the present invention to provide a folding carton that is cut from a single blank of sheet material and is folded into a three-dimensional box configuration without the use of glue or any other means separable from the blank itself of holding the folded blank in the box configuration.

It is also an object of the present invention to provide a folding carton of the type just described that is assembled into its three-dimensional box configuration without the use of glue or a gluing step and also provides a closure at the top of the folded carton that incorporates a carrying handle.

SUMMARY OF THE INVENTION

The folding carton of the present invention includes three separate embodiments of the folding carton, with each embodiment being cut from a single blank of sheet material and each of the embodiments having cut blank configurations that are slight variations of each other.

The configuration of the blank of the first embodiment of the folding carton of the present invention includes a substantially rectangular bottom panel at its center, and pairs of side panels and top panels formed in line with the bottom panel. A first side panel and a second side panel are formed unitarily with the bottom panel at opposite sides of the bottom panel, and are separated from the bottom panel by fold lines. A first top panel and a second top panel are formed unitarily with the first and second side panels respectively, on opposite sides of the side panels from the bottom panel, and are separated from the side panels by fold lines. The first and second top panels also include a first handle portion and a second handle portion respectively. The first and second handle portions are formed unitarily with the first and second top panels and are separated from the panels by fold lines. Projecting hooks that are used in assembling the folding carton into its box configuration are also provided at opposite ends of both the first and second handle portions.

Left and right end flaps are also formed unitarily with the bottom panel. The end flaps extend from opposite ends of the bottom panel and are each separated from the bottom panel by fold lines. Both end flaps converge to rounded points at their distal ends from the bottom panel. Slots are provided in each of the end flaps adjacent to their rounded distal ends. The slots are configured to engage over the hook projections of the first and second handle portions of the top panels in assembling the folding carton to its box configuration.

Left and right end panels extend from the opposite left and right sides of both the first and second side panels. The left end and right end panels are both formed unitarily with the first and second side panels and are separated from the side panels by fold lines. One of the left end panels and right end panels on opposite sides of each side panel is provided with a slot therein, and the other of the left end panels and right end panels is provided with an edge having a hook configuration. The end panels with hooks and slots are positioned in the blank of the folding carton so that an end panel having a slot therein and an end panel having a hook configuration are positioned on opposite sides of both the left end flap and right end flap of the folding carton blank.

The above described single blank of the first embodiment of the invention is easily and quickly folded and assembled into its three-dimensional box configuration without the use of glues or any other equivalent means of adhering one carton component to another.

In assembling the blank of sheet material configured as described above into a folding carton, the first and second side panels and the left and right end flaps are first folded along their fold line connections with the bottom panel so that both the side panels and both the end flaps extend in an upward direction substantially perpendicular to the bottom panel. From this folded configuration of the two side panels and two end flaps, the left end panel and right end panel on the opposite sides of the first and second side panels are then folded over the left and right end flaps so that they substantially overlap the left and right end flaps on the outside of the end flaps from the carton interior. While folding the left end panels and right end panels over the left and right end flaps, the hook configuration formed on one of the end panels on the left and right sides of the folding carton is inserted into the slot formed in the other of the end panels on the left and right sides of the folding carton to secure the left end panels together overlapping the left end flap and to secure the right end panels together overlapping the right end flap. At the end of this step of the folding carton assembly the folding carton is formed in a generally rectangular three-dimensional box configuration with an open top, and with the first and second top panels and the rounded distal ends of the left and right end flaps projecting upward from the open top of the carton.

To close the open top of the carton and form the carrying handle of the folding carton, the first and second top panels of the folding carton are first folded over the opening of the carton. While folding the first and second top panels over the carton opening, the first and second handle portions of the top panels are pressed flat against each other to form the handle of the folding carton. With the first and second handle portions engaging each other, the left end flap and right end flap of the folding carton are now also folded over the top opening and the slots formed in to distal ends of the left and right end flaps are pressed over the hooks projecting from the left and right ends of the first and second handle portions. This secures the first and second handle portions together, forming the carrying handle of the folding carton and completing the assembly of the single blank of sheet material into the folding carton of the present invention.

The second embodiment of the present invention is substantially identical to the first described embodiment with there being only slight variations of the cut configuration of the blank of sheet material of the second embodiment from that of the first embodiment.

The blank of sheet material of the second embodiment of the invention also includes a substantially rectangular bottom panel at its center, and pairs of side panels and top panels formed in line with the bottom panel. The first and second side panels extend from opposite sides of the bottom panel, and the first and second top panels include first and second handle portions identical to the previously described blank of sheet material of the first embodiment of the invention.

The second embodiment of the invention differs from the first described embodiment in the configuration of its left and right end flaps and its left end panels and right end panels. The left and right end flaps of the second embodiment are formed unitarily with the bottom panel on opposite sides of the bottom panel and are separated from the bottom panel by fold lines as the end flaps of the first embodiment of the invention. However, the left and right end flaps of this embodiment have a substantially rectangular configuration and do not extend to rounded points at their distal ends as the end flaps of the first described embodiment.

The left end panels and right end panels of the second embodiment of the invention are also substantially identical to the left end panels and right end panels of the previously described first embodiment of the invention except that the end panels having slots formed therein also include tabs formed unitarily therewith. The tabs extend from the end panels in a direction parallel with the end panel slots to rounded points at their distal ends. The tabs have slots formed therein adjacent their rounded distal ends. The slots are dimensioned to engage over the hook projections on the opposite ends of the handle portions of the folding cartons.

The above described blank of sheet material of the second embodiment of the invention is also easily and quickly folded into its three-dimensional box configuration without the use of glues or other adhesives or any other means of adhering one of the carton components to another. Just as in the first described embodiment, the blank of the second embodiment of the invention is formed into a folding carton by first folding the first and second side panels and the left and right end flaps along their fold line connections with the bottom panel so that both the side panels and both the end panels extend in an upward direction substantially perpendicular to the bottom panel. With the side panels and end flaps extending upward from the bottom panel, the left end panels and right end panels are then folded over so that they overlap the outside of the left and right end flaps respectively. As the left end panels and right end panels are folded over the outsides of the left and right end flaps, the hook configuration formed on one of the left and right end panels is inserted into the slot formed in the other of the left and right end panels just as was done in assembling the carton of the first embodiment of the invention. This secures the left end panels and right end panels together overlapping the exterior of the left and right end flaps, and completes the assembly of the blank of sheet material into its box configuration. In this configuration of the folding carton, the carton is formed into a generally rectangular box having an open top with the first and second top panels extending upward from the top opening and the left and right end tabs extending upward from the left end panels and right end panels respectively. From this configuration, the first and second top panels are folded toward each other over the opening of the box until the first and second handle portions of the top panels engage flush against each other just as was done in assembling the folding carton of the first embodiment. The left and right end tabs are then folded over the top opening of the carton so that the slots formed in the end tabs engage over the hook projections of the first and second handle portions. This secures the first and second handle portions together and secures the first and second top panels and the left and right end tabs in position closing the top opening of the carton.

The blank of sheet material of the third embodiment of the folding carton of the invention is substantially identical to the previously described two embodiments of the invention except for slight variations in the cut configuration of the carton blank.

The blank of the third embodiment of the invention also includes a bottom panel and first and second side panels substantially identical to the previously described embodiments of the invention. However, one of the first and second top panels of this embodiment has a pair of slots formed therein, and the first and second handle portions of the top panels are not provided with hook configurations projecting from their opposite ends. Instead, one of the first and second handle portions has a tab formed at its center, with left and right tongues extending from opposite ends of the tab.

The left and right end flaps of the third embodiment of the folding carton are identical to the left and right end flaps of the second embodiment. Both flaps have a rectangular configuration and are formed unitarily with the bottom panel and are separated from the bottom panel by fold lines.

The left end panels and right end panels of the third embodiment of the folding carton are similar to the left end panels and right end panels of the second embodiment of the folding carton in that the end panels having slots formed therein also include triangular peaks formed unitarily with the panels. The peaks are similar to the pointed tabs of the second embodiment. However, unlike the second embodiment, the peaks of the third embodiment formed unitarily with the left and right end panels are not rounded but extend to points at their distal ends, and the peaks are not provided with slots as are the tabs of the second embodiment.

In assembling the blank of the third embodiment of the invention into its three-dimensional box configuration, the first and second side panels and left and right end flaps are first folded relative to the bottom panel so that they extend in an upward direction substantially perpendicular to the bottom panel. As in the previously described embodiments, the left end panels and right end panels are then folded over the left and right end flaps respectively so that they overlap the outside of the left and right end flaps. While folding the left end panels and right end panels over the left and right end flaps, the hook provided on one of the left and right end panels is inserted into the slot formed in the other of the left and right end panels to secure the end panels together over the exterior of the end flaps. This assembles the blank of the third embodiment of the invention into a three-dimensional box configuration having an open top with the first and second top panels and the left and right peaks extending upward from the open top.

To close the top opening of the folding carton, the first and second top panels are folded over the top opening toward each other so that the first and second handle portions of the top panels lie flat against each other. In this position of the handle portions, the tab formed in one of the handle portions is pressed through the other of the handle portions and is then bent over so that it extends downward and lies over the slots formed in the one top panel. The tongues formed in the opposite ends of the tab are then inserted into the two slots formed in the top panel, thereby securing the first and second top panels together in their closed position over the top opening of the third embodiment of the folding carton.

BRIEF DESCRIPTION OF THE DRAWINGS

Further objects and features of the present invention are revealed in the following detailed description of the preferred embodiment of the invention and in the drawing figures wherein:

FIG. 7 is a perspective view of the third embodiment of the folding carton of the present invention;

FIG. 8 is a side elevation view in section of the third embodiment of the invention taken along the line 8—8 of FIG. 7; and FIG. 9 is a plan view of the single blank of sheet material of the third embodiment of the invention.

DETAILED DESCRIPTION OF THE PREFERRED EMBODIMENTS

Figure 1:
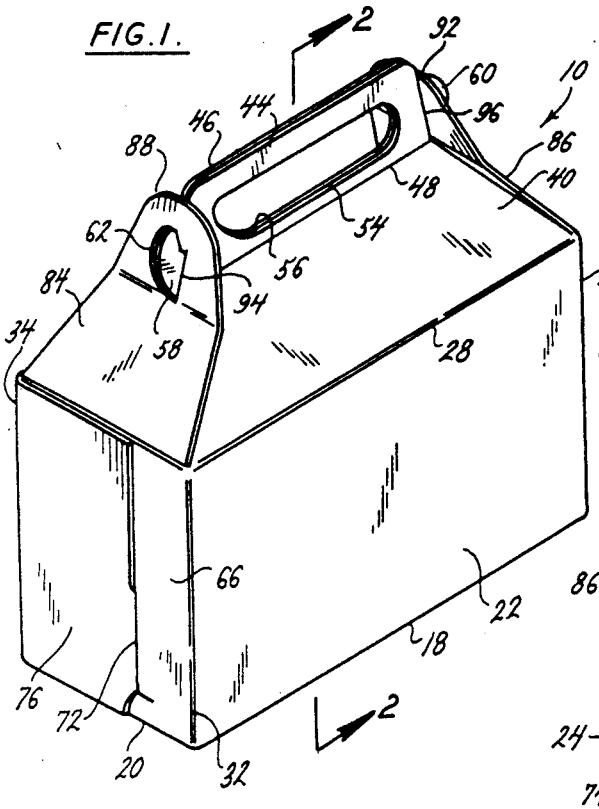
FIG. 1 is a perspective view of the first embodiment of the folding carton of the present invention.
Figure 2:
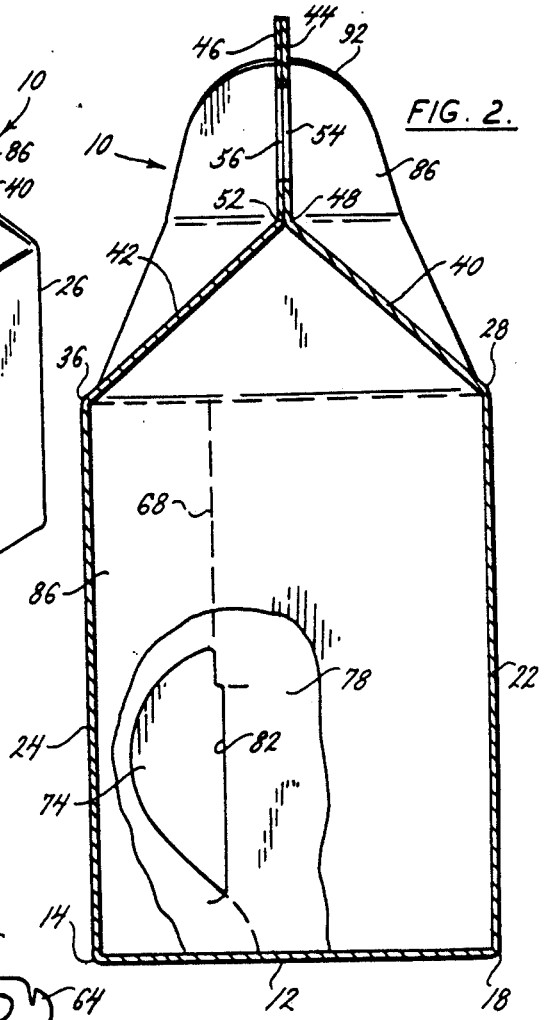
FIG. 2 is a side elevation view in section of the first embodiment of the invention taken along the line 2—2 of FIG. 1.
Figure 3:
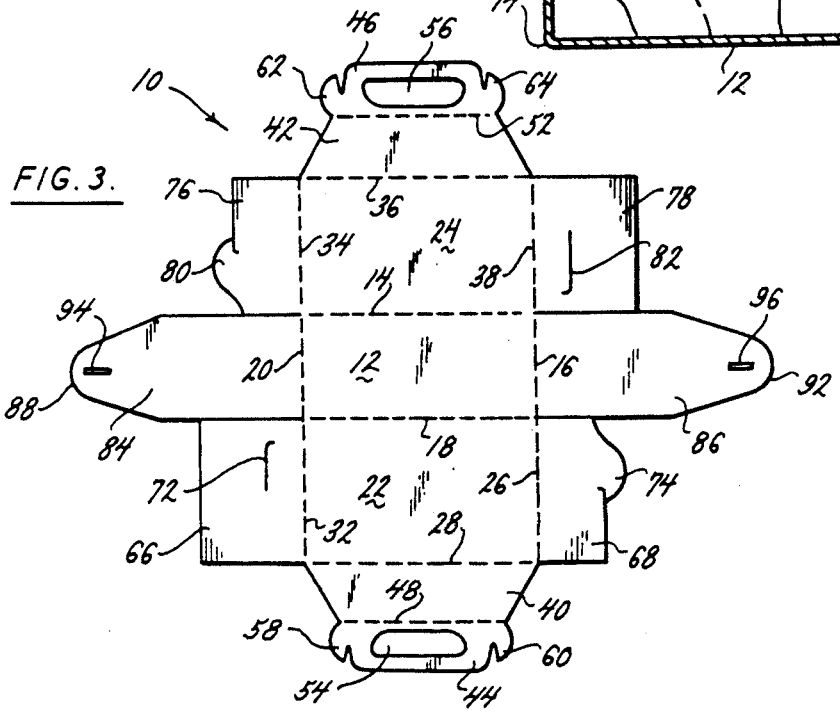
FIG. 3 is a plan view of the single blank of sheet material of the first embodiment of the folding carton of the present invention.
Figure 4:
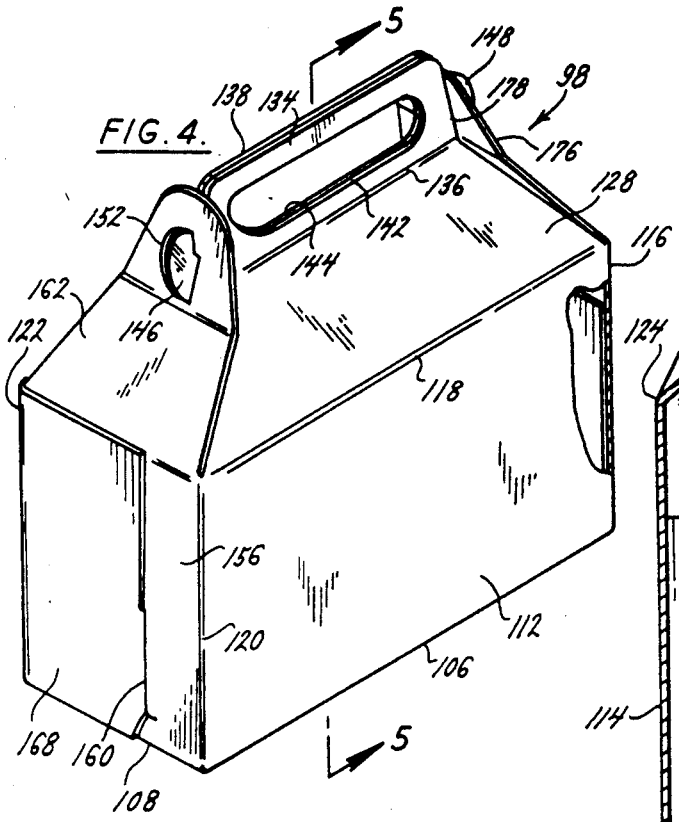
FIG. 4 is a perspective view of the second embodiment of the folding carton of the present invention.
Figure 5:
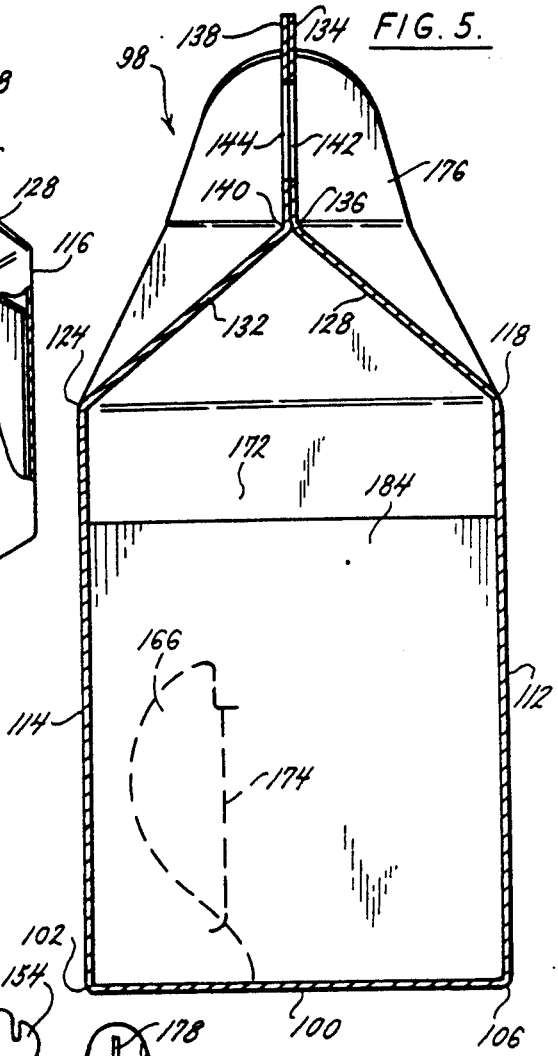
FIG. 5 is a side elevation view in section of the second embodiment of the invention taken along the line 5—5 of FIG. 4.

FIG. 1 shows the first embodiment of the folding carton 10 of the present invention. The blank of this first embodiment of the folding carton is shown in FIG. 3.

The blank of the first embodiment of the folding carton of the present invention 10 is cut from a single sheet of carton material such as paper board or cardboard. The blank includes a substantially rectangular bottom panel 12 at its center that is bordered by four fold lines 14, 16, 18, 20.

First and second side panels 22, 24 are formed unitarily with the bottom panel and are separated from the bottom panel by fold lines 18, 14. Both the first and second side panels are each bordered by three additional fold lines 26, 28, 32, 34, 36, 38.

First and second top panels 40, 42 are formed unitarily with the first and second side panels, respectively, on opposite sides of the side panels from the bottom panel 12. The first and second top panels are separated from the first and second side panels by fold lines 30, 36.

First and second handle portions 44, 46 are formed unitarily with the first and second top panels 40, 42 and are separated from the top panels by fold lines 48, 52 respectively, Each of the first and second handle portions is provided with a handle opening 54, 56 through its center, and the opposite left and right ends of the handle portions are configured in the shape of left and right hook projections 58, 60, 62, 64.

The first side panel 22 also has a first left end panel 66 and a first right end panel 68 formed unitarily therewith along its opposite left and right ends as viewed in FIG. 3. The first left end panel 66 is separated from the first side panel 22 by the fold line 32. The first right end panel 68 is separated from the first side panel 22 by the fold line 28. The first left end panel 66 has a slot 72 formed therein. The slot extends substantially parallel to the fold line 32. A distal end of the first right end panel 68 from its fold line connection to the first side panel 22 is formed in the shape of a hook projection 74.

A second left end panel 76 and a second right end panel 78 are formed unitarily with the second side panel 24 on opposite left and right ends of the side panel respectively. The second left end panel 76 is separated from the second side panel 24 by a fold line 34 and the second right end panel 78 is separated from the second side panel 24 by a fold line 38. The second left end panel 76 has a hook projection 80 formed along its distal end from its fold line connection to the second side panel 24. The second right end panel 78 has a slot 82 formed therein. The slot extends substantially parallel to the fold line 38 separating the second right end panel from the second side panel.

A left end flap 84 and a right end flap 86 are formed unitarily with the bottom panel 12 and extend from opposite left and right ends of the bottom panel respectively. The left end flaps 84 is separated from the bottom panel 12 by a fold line 20 and the right end flap 86 is separated from the bottom panel 12 by a fold line 16. The left end flap 84 has a general rectangular configuration and converges to a rounded tip at its distal end 88 from its fold line connection with the bottom panel 12. The right end flap also has a general rectangular configuration and converges to a rounded tip 92 at its distal end from its fold line connection to the bottom panel. A slot 94 is provided in the left end flap 84 adjacent its rounded tip 88. An additional slot 96 is provided in the right end flap 86 adjacent its rounded tip 92.

The above described single blank of sheet material is folded and assembled into the first embodiment of the folding carton of the present invention without the use of glue or adhesives or other means of adhering one carton component to another.

In folding and assembling the above described blank into the first embodiment of the folding carton of the present invention, the first and second side panels 22, 24 are first folded along the fold lines 18, 14 in an upward direction relative to the bottom panel 12. The left and right end flaps 84, 86 are next folded along the fold lines 20, 16 respectively in an upward direction relative to the bottom panel 12 so that the first and second side panels and the left and right end flaps extend upward substantially perpendicular to the bottom panel 12.

Next, the first and second left end panels 66, 76 and the first and second right end panels 68, 78 are folded over the outside of the left end flap 84 and right end flap 86 respectively. The first left end panel 66 is first folded over the outer surface of the left end flap 84, and then the second left end panel 76 is folded over the outer surface of the first left end panel 66. As the second left end panel 76 is folded over the first left end panel 66, the hook projection 80 of the second left end panel is inserted into the slot 72 formed in the first left end panel. This secures the second left end panel 76 to the first left end panel 66 in an overlapping position over the exterior surface of the left end flap 84. In the same manner, the second right end panel 78 is folded over the outside of the right end flap 86 and the first right end panel 68 is folded over the second right end panel 78. As the first right end panel 68 is folded over the second right end panel 78, the hook projection 74 of the first right end panel is inserted into the slot 82 formed in the second right end panel. This secures the first right end panel 68 to the second right end panel 78 and completes the initial stages of assembling the blank of FIG. 3 into the folding carton configuration of the first embodiment of the invention. In this configuration, the folding carton of the first embodiment of the invention is assembled into a rectangular box configuration with the first and second top panels 40, 42 and the rounded tips 88, 92 of the left and right end flaps 84, 86 extending upward from a top opening of the folding carton.

To close the top opening of the first embodiment of the folding carton and complete the assembly of the folding carton into its box configuration the first and second top panels 40, 42 are next folded over the fold lines 30, 36 respectively, over the top opening of the carton. As the first and second top panels are folded toward each other, the first handle portion 44 and second handle portion 46 are folded along the fold lines 48, 52 respectively, and are pressed flat against each other above the top opening of the carton. In this position of the first and second handle portions, the handle openings 54, 56 of the respective handle portions are aligned with each other and the left 58, 62 and right 60, 64 hook projections of the respective handle portions are also aligned with each other. Next, the rounded tip 88 of the left end flap and the rounded tip 92 of the right end flap are bent over the top opening of the carton toward the first and second handle portions. The slot 94 formed adjacent the rounded tip 88 of the left end flap is engaged over the hook projections 58, 62 at the left end of the first and second handle portions 44, 46 respectively, and the slot 96 formed adjacent the rounded tip 92 of the right end flap is engaged over the hook projections 60, 64 at the right end of the first and second handle portions 44, 46. This secures the first and second handle portions to each other and secures the first and second top panels and the left end flap and right end flap over the top opening of the folding carton closing the opening of the carton and forming the carton carrying handle. This completes the assembly of the blank of FIG. 3 into its folding carton configuration shown in FIG. 1.

Figure 6:
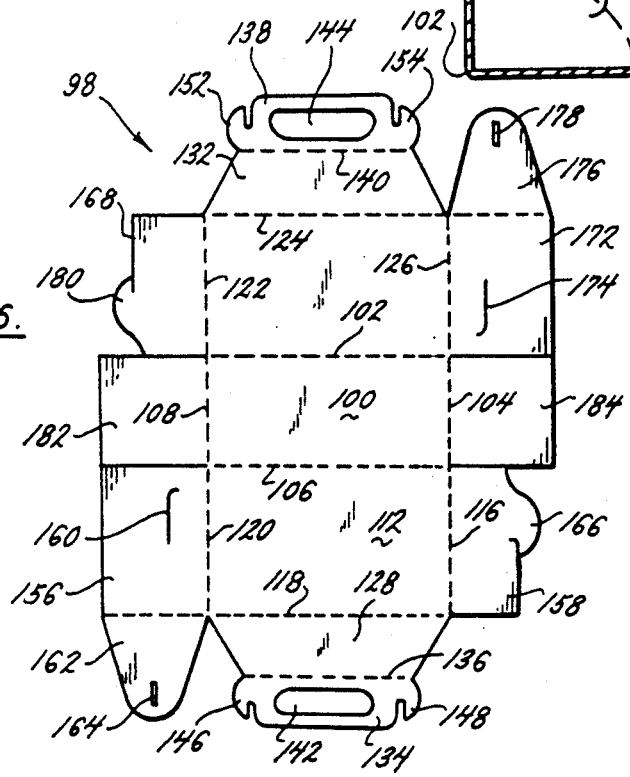
FIG. 6 is a plan view of the single blank of sheet material of the second embodiment of the invention.

The blank of the folding carton of the second embodiment of the invention is similar to that of the first embodiment with only minor variations. The blank of the second embodiment of the invention 98 is also cut from a single sheet of carton material such as paper board or card board. The blank is shown in FIG. 6 and includes a generally rectangular bottom panel 100 at its center bounded by four fold lines 102, 104, 106, 108.

First and second side panels 112, 114 are formed unitarily with the bottom panel. The first and second side panels 112, 114 are provided on opposite sides of the bottom panel 100 and are separated from the bottom panel by fold lines 106, 102 respectively. The first side panel is generally rectangular and is bounded by four fold lines 106, 116, 118, 120. The second side panel is also generally rectangular and is bounded by four fold lines 102, 122, 124, 126.

A first top panel 128 is formed unitarily with the first side panel 112 on an opposite side of the side panel from the bottom panel 100. The first top panel 128 is separated from the first side panel 112 by a fold line 118. A second top panel 132 is formed unitarily with the second side panel 114 on an opposite side of the side panel from the bottom panel 100. The second top panel 132 is separated from the second side panel 114 by a fold line 124.

A first handle portion 134 is formed unitarily with the first top panel 128 on a side of the first top panel opposite its connection to the first side panel 112. The first handle portion 134 is separated from the first top panel 128 by a fold line 136. A second handle portion 138 is formed unitarily with the second top panel 132 on a side of the second top panel opposite its connection to the second side panel 114. The second handle portion 138 is separated from the second side panel 114 by a fold line 140. Both the first and second handle portions are provided with first and second handle openings 142, 144 respectively, through the handle portions. The first handle portion 134 is also provided with left and right hook projections 146, 148 extending from its left and right ends as viewed in FIG. 6. The second handle portion 138 is also provided with left and right hook projections 152, 154 extending from its left and right ends as viewed in FIG. 6.

A first left end panel 156 and a first right end panel 158 are formed unitarily with the first side panel 112 on opposite left and right sides of the side panel respectively, as viewed in FIG. 6. The first left end panel 156 is separated from the first side panel 112 by a fold line 120 and the first right end panel 158 is separated from the first side panel 112 by a fold line 116. The first left end panel 156 has a slot 160 formed therein. The slot 160 extends substantially parallel to the fold line 120 separating the first left end panel from the first side panel. A left end tab 162 is formed unitarily with the first left end panel 156 and extends from the first left end panel in a direction substantially parallel with the slot 160 to a rounded point at its distal end. An additional slot 164 is provided in the left end tab 162 adjacent its rounded point. The first right end panel 158 is provided with a hook 166 configured at its distal end from its fold line connection to the first side panel 112.

A second left end panel 166 and a second right end panel 168 are formed unitarily with the second side panel 114 on opposite left and right ends of the side panel as viewed in FIG. 6. The second left end panel 166 is separated from the second side panel 114 by a fold line 122 and the second right end panel 168 is separated from the second side panel by a fold line 126. The second right end panel is provided with a slot 172 through the panel substantially parallel to the fold line 126 separating the right end panel from the side panel. The second right end panel 168 is also provided with a right end tab 174 that is formed unitarily with the right end panel. The right end tab 174 extends from the second right end panel 168 in a direction substantially parallel to the slot 172 provided in the panel to a rounded tip at its distal end. A slot 176 is provided in the right end tab 174 adjacent its rounded tip. The second left end panel 168 is provided with a hook projection 180 along its distal edge from its fold line connection to the second side panel 114.

A left end flap 182 and a right end flap 184 are formed unitarily with the bottom panel 100 at opposite left and right ends of the bottom panel as viewed in FIG. 6. The left end flap 182 is separated from the bottom panel 100 by a fold line 108 and the right end flap 184 is separated from the bottom panel by a fold line 104.

The above described blank of the second embodiment of the folding carton of the present invention shown in FIG. 6 is quickly and easily folded and assembled into its folding carton configuration without the use of glues or adhesives or any other equivalent means of adhering one carton component to another.

The second embodiment of the folding carton of the present invention is assembled from the single blank of sheet material shown in FIG. 6 in substantially the identical manner as the first embodiment of the folding carton of the invention.

In assembling the second embodiment of the invention, the first and second side panels 112, 114 and the left end flap 182 and right end flap 184 are first folded along the fold lines 106, 102, 108, 104 respectively, in an upward direction relative to the bottom panel 100 so that the first and second side panels and left and right end panels extend upward substantially perpendicular to the bottom panel. Next, the first and second left end panels 156, 168 and the first and second right end panels 158, 172 are folded over the left end flap 182 and right end flap 184 respectively. The first left end panel 156 is first folded over the outside surface of the left end flap 182, and then the second left end panel 168 is folded over the first left end panel. As the second left end panel 168 is folded over the first left end panel 156, the hook configuration 180 projecting from the end of the second left end panel 168 is inserted into the slot 160 provided in the first left end panel 156. Inserting the hook 180 into the slot 160 securely attaches the first and second left end panels together. The second right end panel 172 is also first folded over the outside surface of the right end flap 184 and then the first right end panel 158 is folded over the outside surface of the second right end panel 172. As the first right end panel 158 is folded over the second right end panel 172, the hook projection 166 of the first right end panel is inserted into the slot 174 provided on the second right end panel. Inserting the hook 166 into the slot 174, securely attaches the first right end panel 158 to the second right end panel 172 of the folding carton. With the blank of FIG. 6 assembled in the manner described above, the second embodiment of the folding carton is shaped in its box configuration with an opening at the top and the first and second top panels 128, 132 and left and right end tabs 162, 176 projecting in an upward direction from the carton opening.

The top opening of the carton is closed in much the same manner as the first embodiment of the invention. The first and second top panels 128, 132 are first folded over the top opening at the fold lines 118, 124 respectively. As the first and second top panels are folded toward each other, the first handle portion 134 is pressed flat against the second handle portion 138. This aligns the first handle opening 142 with the second handle opening 144 and aligns the first and second hook projections on the left side of the handle portions 146, 152 and the first and second hook projections on the right side of the handle portions 148, 154. Next, the left end tab 162 and right end tab 176 are folded over the top opening toward the hook projections of the first an second handle portions. The slot 164 in the left end tab 162 is engaged over the aligned hook projections 146, 152 on the left side of the handle portions and the slot 178 provided in the right end tab 176 is engaged over the aligned hook projections 148, 154 on the right hand side of the handle portions. This secures the first and second handle portions together completely closing the top opening of the folding carton and forming a carrying handle for the carton.

The third embodiment of the folding carton of the present invention 186 is shown in FIG. 7. The single blank of sheet material from which this carton is assembled is shown in FIG. 9. As with the previously described embodiments of the invention, the third embodiment of the folding carton is assembled into its three-dimensional box configuration without the use of glue or other adhesives or any other equivalent means of adhering one carton component to another.

As with the previously described embodiments of the invention, the blank of the third embodiment of the folding carton 186 includes a bottom panel 188 at its center. The bottom panel 188 is generally rectangular and is bounded by four fold lines 192, 194, 196, 198.

A first side panel 200 and a second side panel 202 are formed unitarily with the bottom panel 188 on opposite sides of the bottom panel. The first side panel 200 is separated from the bottom panel 188 by a fold line 196 and the second side panel 202 is separated from the bottom panel by a fold line 192. The first side panel 200 is generally rectangular and is bounded by four fold lines 196, 204, 206, 208. The second side panel 202 is also generally rectangular and is bounded by four fold lines 192, 212, 214, 216.

A first top panel 218 is formed unitarily with the first side panel 200 at an opposite side of the side panel from the bottom panel 188. A second top panel 220 is formed unitarily with the second side panel 202 at an opposite side of the side panel from the bottom panel 188. The first and second top panels 218, 220 are also generally rectangular and are connected to the first and second side panels 200, 202 along the fold lines 206, 214 respectively. A pair of slots 222, 224 are provided in the second top panel 220.

A first handle portion 226 is formed unitarily with the first top panel 218 along a side of the first top panel opposite its connection to the first side panel 200. A second handle portion 228 is formed unitarily with the second top panel 220 along a side of the second top panel opposite its connection to the second side panel 202. The first handle portion 226 is separated from the first top panel 218 by a fold line 232, and the second handle portion 228 is separated from the second top panel 220 by a fold line 234. The first handle portion 226 has an oblong handle opening 236 cut therein with a tab 238 extending into the opening from the fold line 232. The tab 238 is generally "T"-shaped and has tongues 239 at its opposite ends. The second handle portion 228 also has an oblong handle opening 240 cut therein with a second tab 242 positioned in the opening and connected with the second handle portion along a fold line 244.

A first left end panel 246 and a first right end panel 248 are formed unitarily with the first side panel 200 on opposite left and right ends of the side panel respectively, as viewed in FIG. 9. The first left end panel 246 is separated from the first side panel 200 by the fold line 208 and the first right end panel 248 is separated from the first side panel 200 by the fold line 204. The first left end panel 246 has a slot 252 formed therein substantially parallel to the fold line 208. A pointed peak 154 extends from the first left end panel 246 in a direction substantially parallel with the slot 252. The first right end panel 248 has a hook configuration 256 along an edge of the end panel opposite its fold line connection to the first side panel 200.

A second left end panel 258 and a second right end panel 260 are formed unitarily with the second side panel 202 at opposite left and right ends of the second side panel as viewed in FIG. 9. The second left end panel 258 is separated from the second side panel 202 by the fold line 212 and the second right end panel 260 is separated from the second side panel by the fold line 216. The second right end panel is provided with a slot 262 substantially parallel with the fold line 216. A pointed peak 264 extends from the second right end panel 260 in a direction substantially parallel with the slot 262. A hook configuration 266 is provided along an edge of the second left end panel 258 opposite its fold line connection to the second side panel 202.

A left end flap 268 and a right end flap 272 are formed unitarily with the bottom panel 188 on opposite left and right ends of the bottom panel as viewed in FIG. 9. The left and right end flaps 268, 272 are generally rectangular and are separated from the bottom panel 188 by the fold lines 198, 194 respectively.

The folding carton of the third embodiment of the invention shown in FIG. 7 is assembled from the above described single blank of sheet material shown in FIG. 9 in substantially the same manner as the previously described embodiments of the invention.

In assembling the third embodiment of the folding carton from the blank of FIG. 9, the first and second side panels 200, 202 and the left end flap and right end flap 268, 272 are first folded along the fold lines 196, 192, 194, 198 respectively to extend in an upward direction from the bottom panel 188. In this position, the first and second side panels and the left and right end flaps are positioned substantially perpendicular to the bottom panel.

Next, the first and second left end panels 246, 258 and the first and second right end panels 248, 260 are folded over the outside surfaces of the left and right end flaps 268, 272 respectively. The first left end panel 246 is first folded over the outside of the left end flap 268 and then the second left end panel 258 is folded over the first left end panel. As the second left end panel 258 is folded over the first left end panel 246, the hook configuration 266 of the second left end panel is inserted into the slot 252 provided in the first left end panel. This securely attaches the first and second left end panels 246, 258 together over the left end flap 268 of the carton blank. The second right end panel 260 is then folded over the outside of the right end flap 272 and the first right end panel 248 is then folded over the second right end panel. As the first right end panel 248 is folded over the second right end panel 260, the hook 256 formed in the first right end panel 248 is inserted in the slot 262 provided in the second right end panel 260. This securely attaches the first and second right end panels together over the outside of the right end flap 272.

At this point in the assembly of the third embodiment of the folding carton, the folding carton is configured in a box-like configuration with an opening at its top and with the first and second top panels 218, 220 and the left and right pointed peaks 254, 264 of the left and right end panels respectively, pointing upward from the top opening of the folding carton.

In closing the top opening of the folding carton the first and second top panels 218, 220 are first folded over the fold lines 206, 214 toward each other until the first and second handle portions 226, 228 engage flat against each other. In this position of the first and second handle portions, the second tab 242 of the second handle portion 228 is pressed through the handle opening of the first and second handle portions and is folded along the fold line 244 to an upward position engaging over the first handle portion 226. This position of the second tab 242 is best seen in FIG. 8. The first tab 238 in the handle opening 236 of the first handle portion 226 is then pressed through the handle openings of the first and second handle portions and is folded over the fold line 232 to a position over the second top panel 220. This position of the first tab is best seen in FIG. 8. The tongues 239 at the opposite left and right ends of the first tab 238 are then inserted into the slots 222, 224 provided in the second top panel 220 of the folding carton to securely close the first and second top panels over the top opening of the folding carton and complete the assembly of the carton.

While the present invention has been described by reference to specific embodiments, it should be understood that modifications and variations of the invention may be constructed without departing from the scope of the invention defined in the following claims.

What is claimed is:

1. A folding carton cut from a single blank of sheet material, the carton comprising:

a bottom panel bordered by a first fold line, a second fold line, a third fold line, and a fourth fold line, the first fold line being opposite the third fold line and the second fold line being opposite the fourth fold line;

a first side panel connected to the bottom panel along the first fold line, the first side panel being bordered by the first fold line and a fifth fold line, a sixth fold line, and a seventh fold line;

a second side panel connected to the bottom panel along the third fold line, the second side panel being bordered by the third fold line and an eighth fold line, a ninth fold line, and a tenth fold line;

a left end flap connected to the bottom panel along the second fold line, the left end flap having a rounded tip opposite the second-fold line and a slot formed in the left end flap adjacent the rounded tip;

a right end flap connected to the bottom panel along the fourth fold line, the right end flap having a rounded tip opposite the fourth fold line and a slot formed in the right end flap adjacent the rounded tip;

a first left end panel connected to the first side panel along the seventh fold line, the first left end panel having a slot formed therein;

a first right end panel connected to the first side panel along the fifth fold line, the first right end panel having a hook projection formed thereon;

a second left end panel connected to the second side panel along the eighth fold line, the second left end panel having a hook projection formed thereon;

a second right end panel connected to the second side panel along the tenth fold line, the second right end panel having a slot formed therein;

a first top panel connected to the first side panel along the sixth fold line, the first top panel having an eleventh fold line provided thereon opposite the first top panel from the sixth fold line;

a second top panel connected to the second side panel along the ninth fold line, the second top panel having a twelfth fold line provided thereon opposite the second top panel from the ninth fold line;

a first handle portion connected to the first top panel along the eleventh fold line, the first handle portion having a first handle opening therein; and, a second handle portion connected to the second top panel along the twelfth fold line, the second handle portion having a second handle opening therein.

2. The folding carton of claim 1, wherein:

a first left hook projection is formed on the first handle portion and a first right hook projection is formed on the first handle portion opposite the first handle portion from the first left hook projection.

3. The folding carton of claim 2, wherein:

a second left hook projection is formed on the second handle portion and a second right hook projection is formed on the second handle portion opposite the second handle portion from the second left hook projection.

4. The folding carton of claim 3, wherein:

the hook projection formed on the first right end panel is engagable in the slot formed in the second right end panel;

the hook projection formed on the second left end panel is engagable in the slot formed in the first left end panel;

the slot formed in the rounded tip of the left end flap is engagable over the first left hook projection formed on the first handle portion and the second left hook projection formed on the second handle portion; and, the slot formed in the rounded tip of the right end flap is engagable over the first right hook projection formed on the first handle portion and the second right hook projection formed on the second handle portion.

5. A folding carton cut from a single blank of sheet material, the carton comprising:

a bottom panel bordered by a first fold line, a second fold line, a third fold line, and a fourth fold line, the first fold line being opposite the third fold line and the second fold line being opposite the fourth fold line;

a first side panel connected to the bottom panel along the first fold line, the first side panel being bordered by the first fold line and a fifth fold line, a sixth fold line, and a seventh fold line;

a second side panel connected to the bottom panel along the third fold line, the second side panel being bordered by the third fold line and an eighth fold line, a ninth fold line, and a tenth fold line;

a left end flap connected to the bottom panel along the second fold line, the left end flap being bordered by the second fold line and three free edges;

a right end flap connected to the bottom panel along the fourth fold line, the right end flap being bordered by the fourth fold line and three free edges;

a first left end panel connected to the first side panel along the seventh fold line, the first left end panel having a first slot formed therein and the first left end panel having an eleventh fold line formed thereon;

a left end tab connected to the first left end panel along the eleventh fold line, the left end tab extending from the first left end panel in a direction parallel to the seventh fold line to a distal point of the left end tab, and a first tab slot being formed in the left end tab adjacent the distal point of the left end tab;

a first right end panel connected to the first side panel along the fifth fold line, the first right end panel having a hook projection formed thereon;

a second left end panel connected to the second side panel along the eighth fold line, the second left end panel having a hook projection formed thereon;

a second right end panel connected to the second side panel along the tenth fold line, the second right end panel having a second slot formed therein and the second right end panel having a twelfth fold line formed thereon;

a right end tab connected to the second right end panel along the twelfth fold line, the right end tab extending from the second right end panel in a direction parallel to the tenth fold line to a distal point of the right end tab, and a second tab slot being formed in the right end tab adjacent the distal point of the right end tab;

a first top panel connected to the first side panel along the sixth fold line, the first top panel having a thirteenth fold line provided thereon opposite the first top panel from the sixth fold line;

a second top panel connected to the second side panel along the ninth fold line, the second top panel having a fourteenth fold line provided thereon opposite the second top panel from the ninth fold line;

a first handle portion connected to the first top panel along the thirteenth fold line, the first handle portion having a first handle opening therein; and, a second handle portion connected to the second top panel along the fourteenth fold line, the second handle portion having a second handle opening therein.

6. The folding carton of claim 5, wherein:

a first left hook projection is formed on the first handle portion and a first right hook projection is formed on the first handle portion opposite the first handle portion from the first left hook projection.

7. The folding carton of claim 6, wherein:

a second left hook projection is formed on the second handle portion and a second right hook projection is formed on the second handle portion opposite the second handle portion from the second left hook projection.

8. The folding carton of claim 7, wherein:

the hook projection formed on the first right end panel is engagable in the slot formed in the second right end panel;

the hook projection formed on the second left end panel is engagable in the slot formed in the first left end panel;

the first tab slot is engagable over the first left hook projection formed on the first handle portion and the second left hook projection formed on the second handle portion; and, the second tab slot is engagable over the first right hook projection formed on the first handle portion and the second right hook projection formed on the second handle portion.

9. A folding carton cut from a single blank of sheet material, the carton comprising:

a bottom panel bordered by a first fold line, a second fold line, a third fold line, and a fourth fold line, the first fold line being opposite the third fold line and the second fold line being opposite the fourth fold line;

a first side panel connected to the bottom panel along the first fold line, the first side panel being bordered by the first fold line and a fifth fold line, a sixth fold line, and a seventh fold line;

a second side panel connected to the bottom panel along the third fold line, the second side panel being bordered by the third fold line and an eighth fold line, a ninth fold line, and a tenth fold line;

a left end flap connected to the bottom panel along the second fold line, the left end flap being bordered by the second fold line and three free edges;

a right end flap connected to the bottom panel along the fourth fold line, the right end flap being bordered by the fourth fold line and three free edges;

a first left end panel connected to the first side panel along the seventh fold line, the first left end panel having a first slot formed therein and a left end tab extending from the first left end panel in a direction parallel to the seventh fold line to a distal point of the left end tab;

a first right end panel connected to the first side panel along the fifth fold line, the first right end panel having a hook projection formed thereon;

a second left end panel connected to the second side panel along the eighth fold line, the second left end panel having a hook projection formed thereon;

a second right end panel connected to the second side panel along the tenth fold line, the second right end panel having a second slot formed therein and a right end tab extending from the second right end panel in a direction parallel to the tenth fold line to a distal point of the right end tab; p1 a first top panel connected to the first side panel along the sixth fold line, the first top panel having an eleventh fold line provided thereon opposite the first top panel from the sixth fold line;

a second top panel connected to the second side panel along the ninth fold line, the second top panel having a twelfth fold line provided thereon opposite the second top panel from the ninth fold line;

a first handle portion connected to the first top panel along the eleventh fold line, the first handle portion having a first handle opening therein; and, a second handle portion connected to the second top panel along the twelfth fold line, the second handle portion having a second handle opening therein.

10. The folding carton of claim 9, wherein:

a pair of slots are formed in the second top panel and a tab is connected to the first top panel along the eleventh fold line, the tab being engagable in the pair of slots formed int he second top panel.

11. The folding carton of claim 10, wherein:

the hook projection formed on the first right end panel is engagable in the slot formed in the second right end panel; and, the hook projection formed on the second left end panel is engagable in the slot formed in the first left end panel.

* * * * *